US007006066B2

(12) United States Patent
Chen et al.

(10) Patent No.: US 7,006,066 B2
(45) Date of Patent: Feb. 28, 2006

(54) DRIVING CIRCUIT FOR LIQUID CRYSTAL DISPLAY AND METHOD FOR CONTROLLING THE SAME

(75) Inventors: Yen Chen Chen, Shanhwa (TW); Bing Jei Liao, Shanhwa (TW); Ying Chou Tu, Shanhwa (TW)

(73) Assignee: Himax Technologies, Inc., Shanhwa (TW)

( * ) Notice: Subject to any disclaimer, the term of this patent is extended or adjusted under 35 U.S.C. 154(b) by 268 days.

(21) Appl. No.: 10/302,948

(22) Filed: Nov. 25, 2002

(65) Prior Publication Data

US 2004/0041768 A1 Mar. 4, 2004

(30) Foreign Application Priority Data

Aug. 27, 2002 (TW) ..... 91119628 A

(51) Int. Cl.
*G09G 3/36* (2006.01)

(52) U.S. Cl. ..... 345/90; 345/88; 345/89; 345/92; 345/98

(58) Field of Classification Search ..... 345/88–89, 345/90, 92, 97–98
See application file for complete search history.

(56) References Cited

U.S. PATENT DOCUMENTS 5,566,010 A * 10/1996 Ishii et al. ..... 349/42
6,329,971 B1 * 12/2001 McKnight ..... 345/95
6,421,037 B1 * 7/2002 Chen ..... 345/92

* cited by examiner

*Primary Examiner*—Vijay Shankar
*Assistant Examiner*—Leonid Shapiro
(74) *Attorney, Agent, or Firm*—Finnegan, Henderson, Farabow, Garrett & Dunner, L.L.P.

(57) ABSTRACT

The driving circuit of a liquid crystal cell structure consists essentially of first and second write-enable transistors, first and second storage capacitors, first and second display-enable transistors, and a reset/preset transistor. When one of the display-enable transistors is turned on such that the video data saved in the corresponding storage capacitor is loaded into the mirror electrode for display, the other corresponding write-enable transistor is turned on simultaneously to pre-load the next video data into the corresponding storage capacitor. When the first and second display-enable transistors both are turned off, the reset/preset transistor is turned on to set the liquid crystal in the reset/preset voltage, wherein the reset/preset voltage is based on the overdrive voltage of the arrangement of the liquid crystal before next sub-frame time so as to increase the response rate of the liquid crystal cell.

22 Claims, 10 Drawing Sheets

W:Array Write Time
X: LC Response Time
Y:Light Strobing Time
Z:Field Switching, etc.

DRIVING CIRCUIT FOR LIQUID CRYSTAL DISPLAY AND METHOD FOR CONTROLLING THE SAME

BACKGROUND OF THE INVENTION

1. Field of the Invention

The present invention is related to a liquid crystal cell structure, and more particularly related to a driving circuit of a liquid crystal on silicon (LCOS) cell structure and a method for controlling the same, which can effectively provide a faster liquid crystal (LC) response time and higher image quality of a display using the liquid crystal on silicon cell structure.

2. Description of the Prior Art

In color displays, there are three major systems for producing different colors and brightness of colors. In the first system, a number of pixels are provided, each pixel transmitting either red, green, or blue light. The pixels are arranged in groups of red, green, and blue. A particular color is achieved in an area by turning on or off the appropriate pixels in that area. For example, if purple is a desired color in an area, the green pixels in that area would remain off and the red and blue pixels would be turned on. The brightness is also controlled by turning on or off the pixels. If bright purple in an area is desired, then all of the red and blue pixels would be turned on in that area. If a darker purple is desired, then some red and blue pixels would turn on partially.

In the second system, similar to the first, a number of pixels are also provided, each pixel transmitting either red, green, or blue light. The pixels are again arranged in groups of red, green, and blue, and again, a particular color is achieved in an area by turning off or on the appropriate pixels in that area. However, brightness is controlled by varying the amount of light being transmitted by a pixel which is on, rather than turning off some of the pixels. As in the first system, if bright purple in an area is desired, then all of the red and blue pixels would be turned on in that area. If a darker purple is desired in an area, then rather than having some of the red and blue pixels remain off in that area, all of the red and blue pixels transmit light, but the amount of light being transmitted from each pixel varies. This second system allows for higher resolution than the first system. Another system similar to this second type is disclosed in which liquid crystals are used as light valves to alter the polarization of incident light on pixels such that more or less of the light striking the pixels will ultimately be transmitted to a display through a beam splitter.

The third system for producing a color display with various colors and brightness of colors is commonly known as field sequential color. In a field sequential color system, each pixel transmits, sequentially in time, red, green, and blue light. When the transmission is fast enough, the human brain fuses all three colors of light into a single color, which is a blend of the colors. Color and brightness of color can be controlled in the time domain. For example, if a bluish, purple color is desired from the pixel during a certain time period, the pixel will transmit blue light longer than red light, and it will transmit no green light. Field sequential color is advantageous in that it allows for very high resolution, since each pixel is independent of its neighbors and can assume any color. However, it has limitations which make it a challenge to commercially exploit, including a requirement for extremely high switching rates. This is in part needed to reduce certain undesirable color effects, including rainbows and color flashes associated with moving objects.

The liquid crystal display (LCD) has been considered a very important screen display device for holding display data. One conventional display device for holding display data in units of pixels is sometimes referred to as a TFT (Thin-Film-Transistor) active matrix type liquid crystal display device or TFT LCD device which has many pixels arranged in a matrix. A color pixel is formed usually by combining three pixels. However, the size of a conventional TFT LCD device is relatively large. In view of its large size, the conventional TFT LCD device can only be fabricated on a piece of large glass substrate with poly-silicon thin-film transistors.

As a consequence, in recent years, there has been developed a new class of mini-display based on a single crystal silicon substrate. The newer mini-displays can be manufactured using current CMOS technological processes, which can provide better yield and a higher level circuit integration than the existing TFT LCD devices. These mini-displays are referred to as liquid crystal on silicon (LCOS) devices, which are in essence miniature version of the TFT LCD device. In fact, the LCD portion of the mini-display is quite similar to that of the TFT LCD device, but is made on a much smaller scale (e.g. on top of a silicon chip). The image on top of the mini-display is typically magnified for viewing by an optical system. Dependent upon the particular application, the optical system may be quite complex.

The specific applications for the LCOS device can be generally classified into three major categories. Firstly, the current important application is for use in the area of very large screen projectors in which the size of the display device is about thirty inches or more. Secondly, the application is for utilization as a desktop computer monitor in which the size of the display device is in the range between seventeen and thirty inches. Lastly, the third application for the LCOS device is for use as a portable personal display unit.

FIG. 1 is an exploded, perspective view of a conventional LCOS display device 10, which includes a silicon chip substrate 12, a plurality of bonding pads 14 disposed on its peripheral edges, and a display cell array 16 located in the central part of the substrate 12. A circuit area 18 is positioned around the cell array 16. A top glass cover 20 having a seal-ring 22 is securely mounted over the display cell and the circuit area, with a liquid crystal (LC) layer sandwiched therebetween. Because of the non-transparency of the silicon substrate, the structure is suitable for the reflective mode. FIG. 2*a* is a schematic circuit diagram of a conventional LCOS cell structure having one transistor and one capacitor. The LCOS cell structure 204 comprises a transistor T1 having a gate, a drain, and a source, a storage capacitor Cs, a mirror electrode 206, a top electrode 208, and a liquid crystal 209 sandwiched between the mirror electrode and the top electrode. The transistor T1 has its gate connected to the corresponding wordline WL. The transistor T1 has its source connected to a bitline BL. The transistor T1 has its drain connected to the mirror electrode 206 and one end of the storage capacitors Cs together, and the other end of the storage capacitor Cs is connected to a ground potential. The cell structure is also called 1C1M (one capacitor one mirror) cell. There are two reason illustrated by the figure that the LCOS cell structure is smaller than the conventional TFT-LCD device. First, a gate insulating film used for forming the storage capacitor is extremely thin and thus the surface area thereof can be made smaller than the conventional TFT device. Secondly, the access transistor can be fabricated at any location under the mirror plate without causing a blockage of light.

As a consequence, the proprietor develops a technique to generate a color image from the LCOS display device according to the three color display described above. For example, in a large screen projection type color display device, there are always three LCOS devices used together with precision optics so as to process the three colors, corresponding to red (R), green (G), and blue (B). On the other hand, in a portable type display device where there is a concern for size, weight, and/or cost, only one LCOS device is used on which a color image must be generated. In order to achieve the color image for the portable display, there are three-pixel cells used within the LCOS device which is then covered with color filters for the corresponding RGB colors. However, the pixel array area becomes then approximately three times larger which is unsuitable for a high yield on the CMOS silicon technology. In addition, the use of color filters makes the standard CMOS silicon process more complex and thus increases cost.

In order to overcome these disadvantages, there have been developed a prior art technique of creating a color image in a one-pixel cell which is referred to as a "Field Sequential" (FS) method. This FS method writes RGB data to each of the one-pixel cells in the pixel array in three sequential operations at three times the clock rate. During each of the three sequential operations, a corresponding RGB light source is driving synchronously.

FIG. 2*b* is a timing diagram showing the sequences of operation of the LCOS cell structure of FIG. 2*a*. A frame time is divided into three sub-frame times: a red-field, green-field and blue-field time; and each of the red-field, green-field and blue-field time divided into only three pipe times consisting of an LC response time, a light-strobing time, and a reset/preset time (field switching time too short to be neglected). The video image quality depends on the light-strobing time so that a higher quality video image is allowed by increasing the light-strobing time.

This FS method will function acceptably as long as the response time of the liquid crystal LC is sufficient enough. If this is the case, then the three sequential colors will be effectively combined into a single color image. Therefore, the effective LC response time for each of colors is ⅓ of the frame time reduced by the amount of time it takes to write a color field. However, a serious problem arises when this FS method is utilized in a relatively large display device. This is because there may not be enough time for the LC to respond. For instance, a standard 60 frames/sec video signal has a total time of 16.67 ms for displaying a frame. In the case of the three-pixel cells where the RGB colors can be processed in parallel, each color has a full frame time so as to process and then display the video data. On the other hand, in the FS operation each of the colors has only ⅓ of the frame time or 5.56 ms in order to write data to the storage capacitors, to then wait for the LC to respond, and to then finally strobe the pixel array with the corresponding RGB light source. The length of time for light strobing (LS) the pixel array will determine the brightness of the color image. Consequently, in order to achieve a high image quality in the LCOS device operated with the FS method, it has become necessary to effectively increase the LS time.

FIG. 3*a* is a schematic circuit diagram of a conventional LCOS cell structure having six transistors and three capacitors. FIG. 3*b* is a timing diagram showing the sequences of operation of the LCOS cell structure of FIG. 3*a*. The detail technology can be seen in U.S. Pat. No. 6,421,037 issued to C. L. Chen on Jul. 16, 2002 entitled "Silicon-Chip-Display cell structure", which is incorporated herein by reference.

Additionally, the requirement of liquid crystal response rate in the display mechanism of LCD using FS model is faster than that of liquid penal of iconmeter LCD or LCD using three-piece projection, since only one black and white panel need to display in color. If the LCD is driven at 180 Hz (60*3), a frame time will be divided into three sub-frame times for red, green and blue color. Therefore, the liquid crystal response rate will be preferably as fast as possible. In general, the LCD panel using FS model is often selected from the LCD panel of the ferro-electric liquid crystal model, which is using ferro-electric liquid crystal material, or TN model (pitch <1.5 Uum), which is used for manufacturing thin LCD panel, so as to achieve the colored requirement. However, both of the LCD panel techniques have problems of lower reliability for the product, especially the manufactures continuously devote to overcome the problems of lower reliability in the application of ferro-electric liquid crystal model on LCOS. There are only samples of the ferro-electric liquid crystal model for demonstration. Therefore, the LCD product of ferro-electric liquid crystal model having fast response will be not present in the near future, and the main stream product is still TN model LCD. For the TN model LCD, in addition to selecting the liquid crystal material with low viscosity coefficient, the method for increasing the response rate is reducing the cell gap of the liquid crystal. However, reducing the cell gap of the liquid crystal results in problem of reducing the manufacturing reliability since the class of the clean room must increase after reducing the cell gap, and the problem of particle seriously affect the reliability. Moreover, the cell gap needs more precision, and the tolerance of the cell gap reduces. Furthermore, if the liquid crystal material with high Dn needs to be selected, the selectivity of the liquid crystal material is small. Therefore, reducing of the cell gap not only reduces the manufacturing reliability but also increases the manufacturing cost.

Therefore, based on above reason, there is needed to provide a driving circuit of liquid crystal on silicon (LCOS) liquid crystal cell in a reasonable and high reliability range of current process providing faster LC response time and higher image quality of a display using the LCOS cell structure.

SUMMARY OF THE INVENTION

It is an object of the present invention to provide a driving circuit and a control method of the liquid crystal on silicon, which can provide a higher video image quality by allowing the liquid crystal (LC) response time to be shortened.

It is another object of the present invention to provide a driving circuit and a control method of the liquid crystal on silicon, which have higher circuit integration and manufacturing reliability than the conventional display.

It is further object of the present invention to provide a driving circuit and a control method of the liquid crystal on silicon, which can overdrive effectively the LC to allow the liquid crystal (LC) response time to be shortened.

It is still another object of the present invention to provide a driving circuit and a control method of the liquid crystal on silicon, which can provide a higher video image quality by allowing the LC light-strobing time to be increased.

In accordance with the above objects, the present invention provides a driving circuit of a liquid crystal cell structure for controlling an LCD operable in a field sequential mode. The LCD has a top electrode, a lower electrode, and a liquid crystal sandwiched between the top electrode and the lower electrode. The driving circuit consists essentially of first and second write-enable transistors, first and second storage capacitors, first and second display-enable transistors and a reset/preset transistor. In one preferred embodiment, when one of the display-enable transistors is turned on such that the video data saved in the corresponding storage capacitor is loaded into the mirror electrode for display, the other corresponding write-enable transistor is simultaneously turned on so to pre-load the next video data into the corresponding storage capacitor. When the first and second display-enable transistors both are turned off, the reset/preset transistor is turned on to set the LC in the reset/preset voltage, wherein the reset/preset voltage is based on the overdrive voltage of the arrangement of the liquid crystal before next sub-frame time. As a consequence, the driving circuit and a control method of the liquid crystal on silicon of the present invention are not only saving the data loading time but also shortening the LC response time so as to improve the video image quality of the display used the same circuit.

BRIEF DESCRIPTION OF THE DRAWINGS

These and other objects and advantages of the present invention will become more apparent from the following detailed description when read in conjunction with the accompanying drawings with like reference numerals indicating corresponding parts throughout.

DESCRIPTION OF THE PREFERRED EMBODIMENTS

The driving circuit and the control method of the liquid crystal display of the present invention is described in detail based on an LCOS display device. It is to be understood that the driving circuit and the control method of the liquid crystal display of the present invention is not only used in a reflection LCD such as the LCOS display device but also in a transmission LCD.

Figure 4:
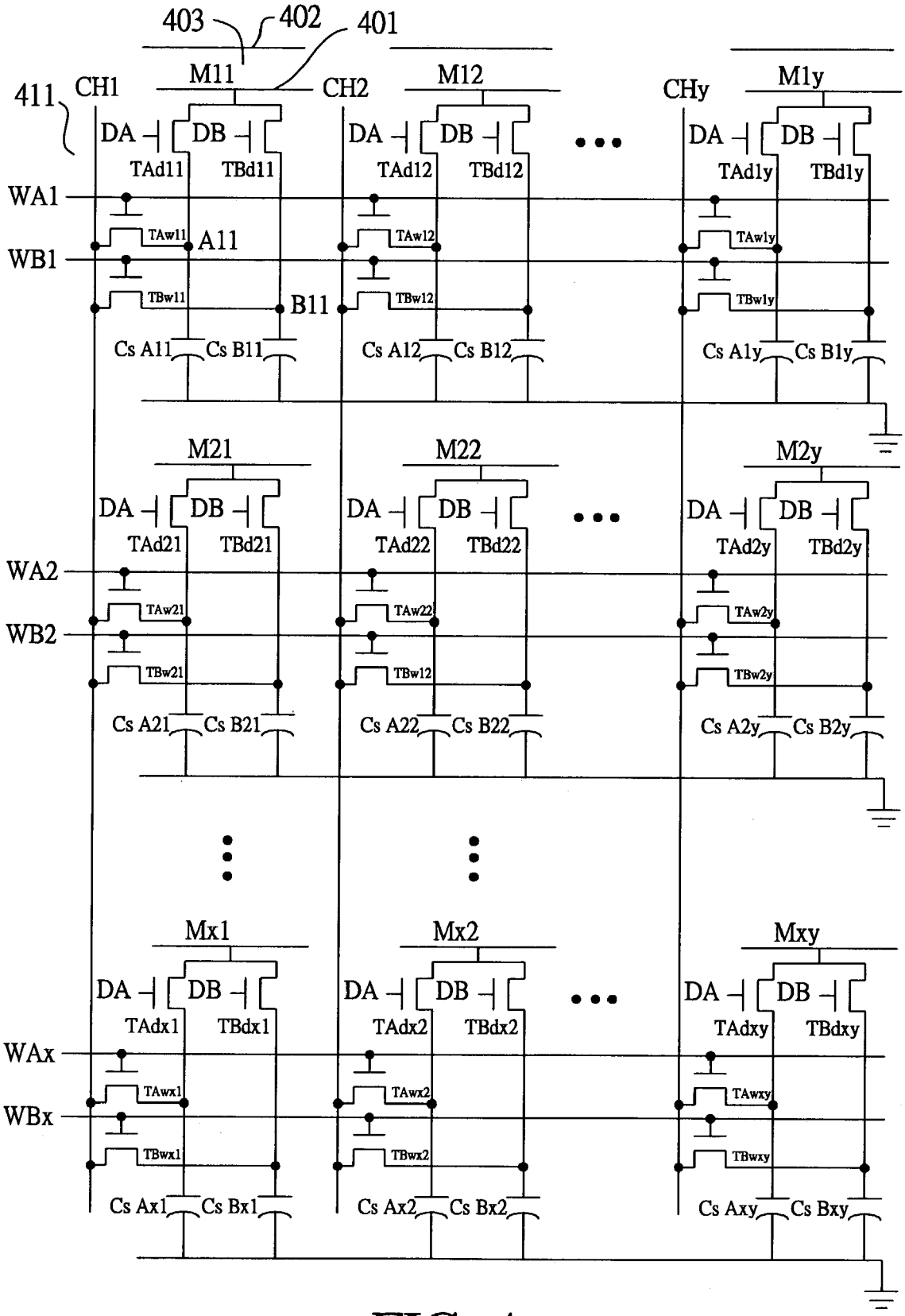
FIG. 4 is a schematic circuit diagram of an array structure of an improved LCOS cell wherein each cell has four transistors and two capacitors constructed in accordance with the first embodiment of the present invention.

Referring to FIG. 4, there is shown a driving circuit diagram having four transistors and two capacitors constructed in accordance with the first embodiment of the present invention. Such a novel driving method of the driving circuit is implemented by providing a designed circuit such that each cell under pixels has a function of pre-loading signal respectively.

Although FIG. 4 shows the whole array structure of the LCOS cell, it is hereinafter described with the LCOS cell 411 in the cross-portion of the first line and first row. In accordance with the first embodiment of the present invention, the LCOS cell 411 comprises two write-enable transistors TAw11 and TBw11 and two storage capacitors Cs_A11 and Cs_B11. Each write-enable transistor has a gate, source and drain. The respective gates of the write-enable transistors TAw11 and TBw11 are connected to their corresponding wordlines WA1 and WA2. The sources of the write-enable transistors TAw11 and TBw11 are connected to a shared bitline CH1. The respective drains of the write-enable transistors TAw11 and TBw11 are connected to one end of their corresponding storage capacitors Cs_A11 and Cs_B11 at respective inter-nodes A11 and B11. The other end of the storage capacitors Cs_A11 and Cs_B11 are connected to a ground potential.

Furthermore, the LCOS cell 411 comprises two display-enable transistors TAd11 and TBd11, and each transistor has a gate, source and drain. The respective gates of the display-enable transistors TAd11 and TBd11 are connected to their corresponding display-enable lines DA and DB. The drains of the display-enable transistors TAd11 and TBd11 are together connected to a common point M11 on a mirror plate 401 (lower electrode). The respective sources of the display-enable transistors TAd11 and TBd11 are connected to the nodes A11 and B11 respectively. A top electrode 402 is formed in a spaced-apart relationship to the mirror plate 401 with an LC layer 403 sandwiched there between.

Figure 5:
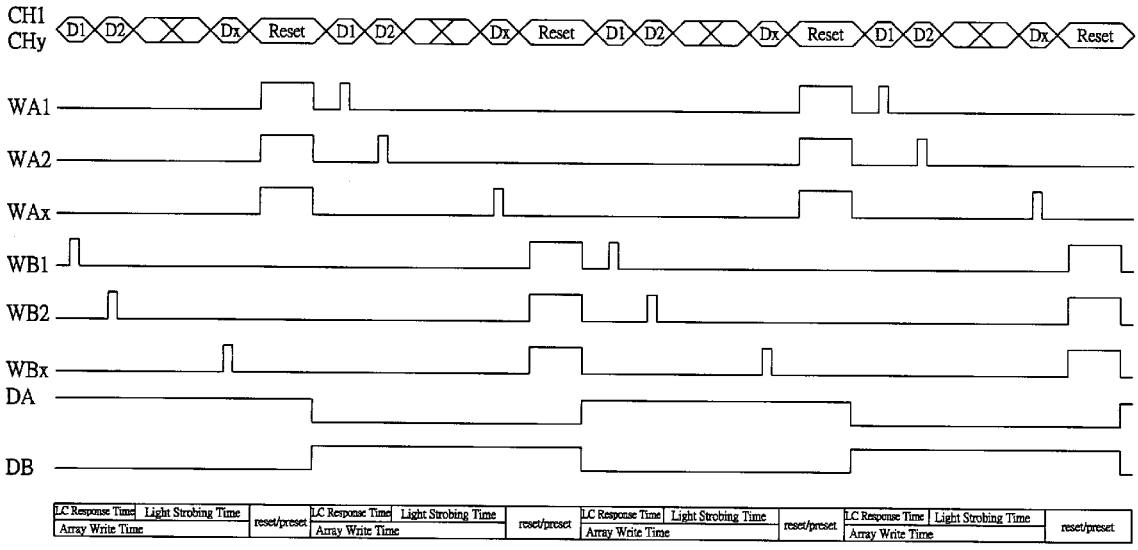
FIG. 5 is a timing diagram showing the sequences of operation of the improved LCOS cell structure of FIG. 4.

FIG. 5 is a timing diagram showing the sequences of operation of the improved LCOS cell structure of FIG. 4. Each frame time is divided into three sub-frame times: a red-field, green-field and blue-field time. Each of the red-field, green-field and blue-field time is further divided into three pipe times consisting of an LC response pipe time, a light-strobing pipe time, and a reset/preset time. Alternatively, each of the red-field, green-field and blue-field times also can be divided into three pipe times consisting of a reset/preset time, an LC response pipe time, and a light-strobing pipe time according to a different definition. The former is used for illustration of this embodiment. In FIG. 5, it shows the operation sequence of CH1, CHy, WA1, WA2, WAx, WB1, WB2, WBx, DA and DB. CH1 and CHy are representative of signal lines. WA1, WA2 to WAx are representative of the first row to xth row of wordlines connected to the corresponding row of first write-enable transistors. WB1, WB2 to WBx are representative of the first row to xth row of wordlines connected to the corresponding row of second write-enable transistors. DA and DB are representative of the display-enable lines respectively connected to the first and the second display-enable transistor. The timing of the operation sequence of the LCOS cell, in general, is controlled by a controller (not shown in FIG. 4). The controller can be a driving IC, a logic IC or microprocessor. The timing of the operation sequence of the LCOS cell is written into the controller by a program. Although FIG. 4 shows the whole array structure of the LCOS cell, it is hereinafter described with the LCOS cell 411 in the cross-portion of the first line and first row. For example, the operating sequence starts at a first sub-frame time, namely the red field time. During the red field time, all the display-enable transistors TAd11~TAdxy are turned on by the display signal DA, and the video data of the red field time saved in the storage capacitors Cs_A11~Cs_Axy are loaded into their corresponding mirror electrodes 403 M11~Mxy for display. At the same time, the video data of the green field time is pre-loaded into the storage capacitors Cs_B11~Cs_Bxy by scanning the signal WB1~WBx. After the end of the red light-strobing time, all the write-enable transistors TAw11~TAwxy are turned on by scanning signal WA1~WAx while the display-enable transistors TAd11~TAdxy are still turned on, and the display-enable transistors TBd11~TBdxy and write-enable transistors TBw11~TBwxy are turned off. Then, the reset/preset signal (equal to Vcom or zero potential) is sent through the bitlines CH1~CHy to discharge or reset the LC voltage to zero potential and the display-enable transistors TAd11~TAdxy and write-enable transistors TAw11~TAwxy are turned off so as to enter the next green field time.

During the green field time, all the display-enable transistors TBd11~TBdxy are turned on by the display signal DB, and the video data of the green field time saved in the storage capacitors Cs_B11~Cs_Bxy are loaded into their corresponding mirror electrodes M11~Mxy for display. At the same time, the video data of the blue field time are pre-loaded into the storage capacitors Cs_A11~Cs_Axy by scanning signal WA1~WAx. After the end of the green light-strobing time, all the write-enable transistors TBw11~TBwxy are turned on by scanning signal WB1~WBx while the write-enable transistors TBd11~TBdxy are still turned on, and the display-enable transistors TAd11~TAdxy and write-enable transistors TAw11~TAwxy are turned off. Then, the reset/preset signal (equal to Vcom or zero potential) is send through the bitlines CH1~Chy to discharge or reset the LC voltage to zero potential and the display-enable transistors TBd11~TBdxy and write-enable transistors TBw11~TBwxy are turned off so as to enter the next blue field time.

During the blue field time, all the display-enable transistors TAd11~TAdxy are turned on by the display signal DA, and the video data of the blue field time saved in the storage capacitors Cs_A11~Cs_Axy is loaded into corresponding mirror electrodes M11~Mxy for display. At the same time, the video data of the red field time is loaded into the storage capacitors Cs_B11~Cs_Bxy by scanning the signal WB1~WBx. After the end of the blue light-strobing time, all the write-enable transistors TAw11~TAwxy are turned on by scanning signal WA1~WAx while the display-enable transistors TAd11~TAdxy are still turned on, and the display-enable transistors TBd11~TBdxy and write-enable transistors TBw11~TBwxy are turned off. Then, the reset/preset signal (equal to Vcom or zero potential) is sent through the bitlines CH1~CHy to discharge or reset the LC voltage to zero potential and the display-enable transistors TAd11~TAdxy and write-enable transistors TAw11~TAwxy are turned off so as to enter the next red field time. Therefore, the actions of red, green and blue of a frame time are completed, and the next frame time is repeated in the same manner so as to achieve the image display.

Figure 6:
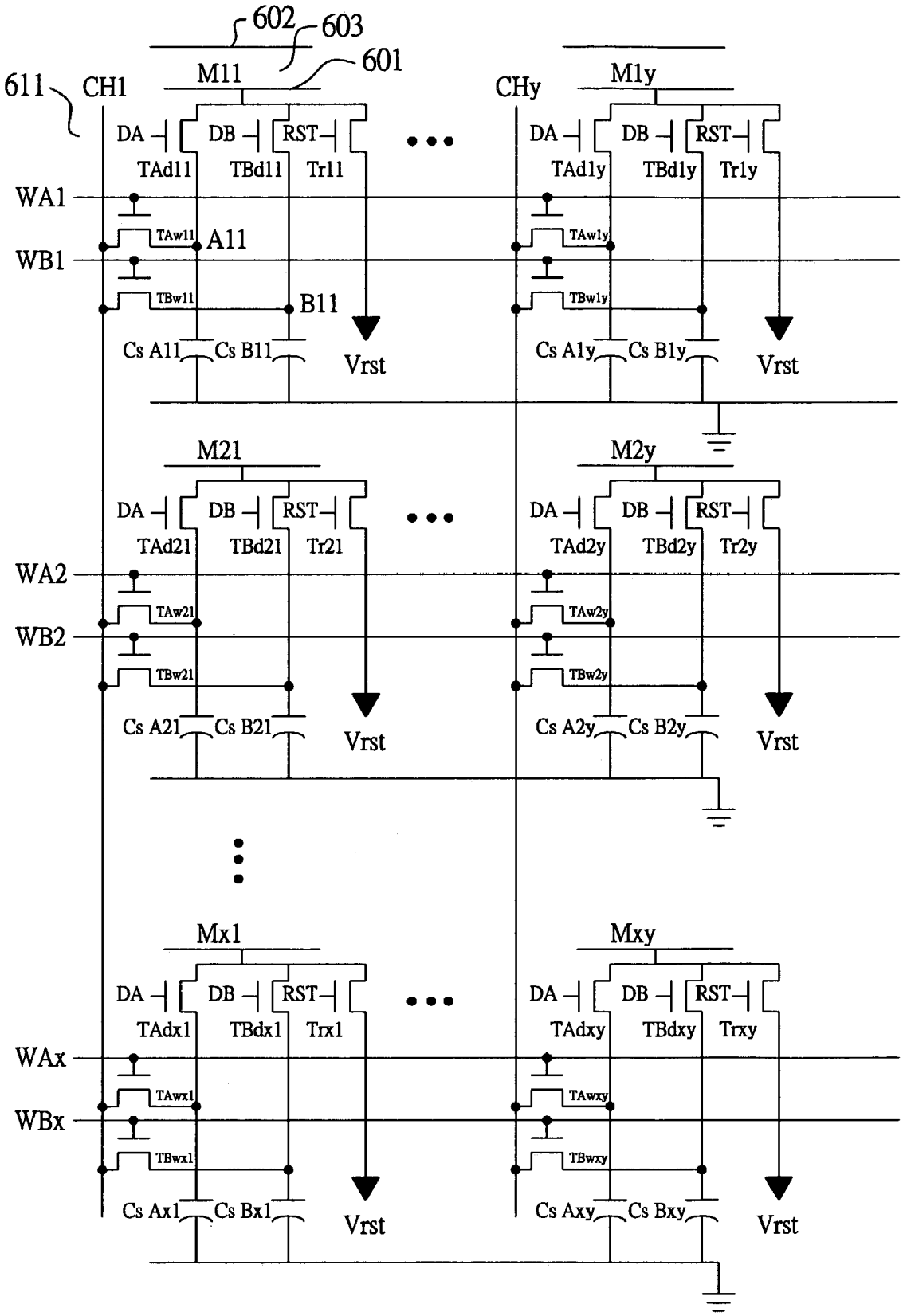
FIG. 6 is a schematic circuit diagram of an array structure of an improved LCOS cell wherein each cell has five transistors and two capacitors constructed in accordance with the second embodiment of the present invention.
Figure 7:
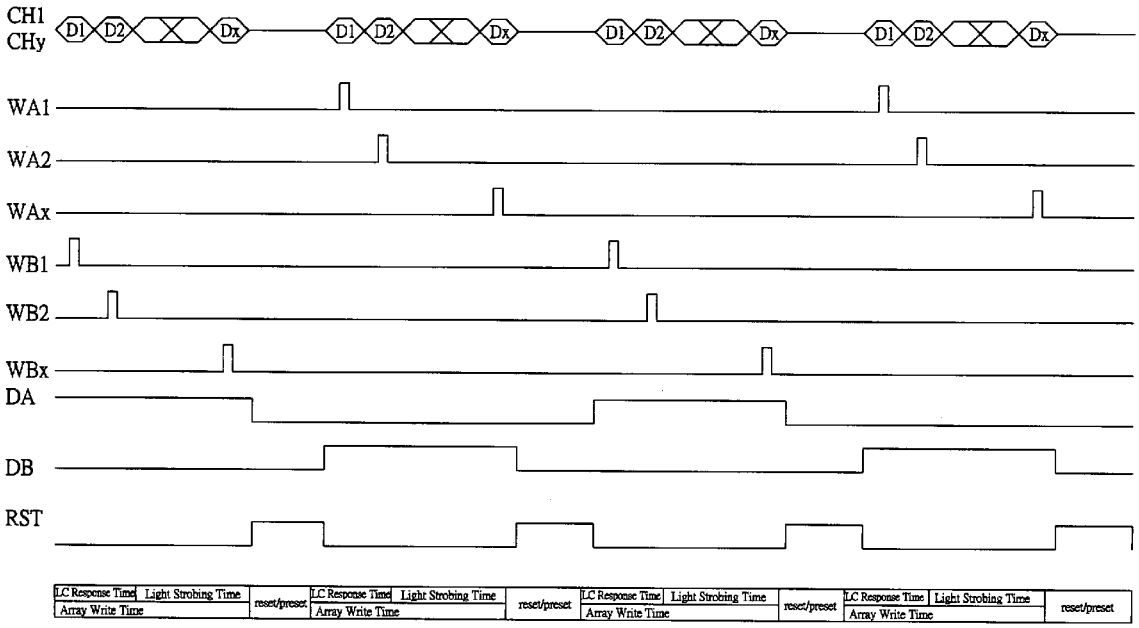
FIG. 7 is a timing diagram showing the sequences of operation of the improved LCOS cell structure of FIG. 6.

Now referring to FIG. 6 and FIG. 7, FIG. 6 is a schematic circuit diagram of the improved LCOS cell structure, having five transistors and two capacitors, constructed in accordance with the second embodiment of the present invention. Although FIG. 6 shows the whole array structure of the LCOS cell, it is hereinafter described with the LCOS cell 611 in the cross-portion of the first line and first row. In accordance with the second embodiment of the present invention, the LCOS cell 611 comprises two write-enable transistors TAw11 and TBw11 and two storage capacitors Cs_A11 and Cs_B11. Each write-enable transistor has a gate, source and drain. The respective gates of the write-enable transistors TAw11 and TBw11 are connected to their corresponding wordlines WA1 and WA2. The sources of the write-enable transistors TAw11 and TBw11 are connected to a shared bitline CH1. The respective drains of the write-enable transistors TAw11 and TBw11 are connected to one end of their corresponding storage capacitors Cs_A11 and Cs_B11 at respective inter-nodes A11 and B11. The other end of the storage capacitors Cs_A11 and Cs_B11 are connected to a ground potential. The LCOS cell 611 comprises two display-enable transistors TAd11 and TBd11, and each transistor has a gate, source and drain. The respective gates of the display-enable transistors TAd11 and TBd11 are connected to their corresponding display-enable lines DA and DB respectively. The drains of the display-enable transistors TAd11 and TBd11 are together connected to a common point M11 on a mirror electrode 601. The respective sources of the display-enable transistors TAd11 and TBd11 are connected to the nodes A11 and B11 respectively. A top electrode 602 is formed in a spaced-apart relationship to the mirror electrode 601 with an LC layer 603 sandwiched there between.

In order to achieve the object and characteristic of over-driving LC of the present invention, the LCOS cell 611 further comprises a reset/preset transistor Tr11 having a gate, source, and drain, wherein the gate is connected to a timing line RST, the source is connected to a reset/preset voltage Vrst, and the drain is connected to common node M11 of the mirror electrode 601. The reset/preset transistor Tr11 is turned on by control of the timing line RST before or after the sub-frame time of red, green and blue for resetting or presetting the voltage of mirror electrode 601 to a reset/preset voltage Vrst, rather than the bitline CH1 transmits the reset/preset signal, so as to prevent the color potential from cross vibration. Although the cell structure of the second embodiment uses one more transistor than that of the first embodiment, it can precisely reset or preset the voltage of the mirror electrode 601 to the reset/preset voltage and reduce the logic control of the bitline.

FIG. 7 is a timing diagram showing the sequences of operation of the improved LCOS cell structure of FIG. 6. Each frame time is divided into three sub-frame times: a red-field, green-field and blue-field time. Each of the red-field, green-field and blue-field time is further divided into three pipe times consisting of an LC response pipe time, a light-strobing pipe time, and a reset/preset time. Alternatively, each of the red-field, green-field and blue-field time also can be divided into three pipe times consisting of a reset/preset time, an LC response pipe time, and a light-strobing pipe time according to different definition. The former is used for illustration of this embodiment. The timing of the operation sequence of the LCOS cell, in general, is controlled by a controller (not shown in FIG. 6). The controller can be a driving IC, logic IC or microprocessor. The timing of the operation sequence of the LCOS cell is written into the controller by a program.

For example, the operating sequence starts at first sub-frame time, namely the red field time. The first display-enable transistor TAd11 is turned on, through the LC response time and the light-strobing time of the red-field time until the presence of the reset/preset time, so as to provide the video data of red color pre-loaded in the first storage capacitor Cs_A11 into the mirror 601. The LC response time and the light-strobing time of the red-field time provide enough time for the LC layer 603 for response and display. At the same time, the second write-enable transistor TBw11 is turned on to sequentially pre-load the video data of the green color into the second storage capacitor Cs_B11 during the LC response time and the light-strobing time of the red-field time. During the reset/preset time of the red-field time, the first display-enable transistor TAd11, the first write-enable transistor TAw11, the second display-enable transistor TBd11 and the second write-enable transistor TBw11 are all turned off while the reset/preset transistor Tr11 is turned on to transmit a reset/preset voltage Vrst to set the voltage of the LC layer 603.

In the next sub-frame time, namely, the green field time, the second display-enable transistor TBd11 is turned on, through the LC response time and the light-strobing time of the green-field time until the presence of the reset/preset time, so as to provide the video data of green color pre-loaded in the second storage capacitor Cs_B11 into the mirror 601. The LC response time and the light-strobing time of the green-field time provide enough time for the LC layer 603 for response and display. At the same time, the first write-enable transistor TAw11 is turned on to sequentially pre-load the video data of the blue color into the first storage capacitor Cs_A11 during the LC response time and the light-strobing time of the green-field time. During the reset/preset time of the green-field time, the first display-enable transistor TAd11, the first write-enable transistor TAw11, the second display-enable transistor TBd11 and the second write-enable transistor TBw11 are all turned off while the reset/preset transistor Tr11 is turned on to transmit a reset/preset voltage Vrst to set the voltage of the LC layer 603. The above steps then process and repeat sequentially according to an order of the blue time, the red time and the green time, wherein each repetition alternates use of the first and second write-enable transistors, the first and second display-enable transistors, and the first and second storage capacitors. Although the field sequence of the above embodiment of the present invention is in the order of red, green and blue, any field sequence combination of red, green and blue can also achieve the objects and functions of the present invention.

The "reset" of the reset/preset transistor Tr11 means that a sub-frame time is sequentially divided into three pipe times: an LC response time, a light-strobing time, and a reset/preset time. The "preset" of the reset/preset transistor Tr11 means that a sub-frame time is sequentially divided into three pipe times: a reset/preset time, an LC response time and a light-strobing time. The reset/preset voltage Vrst can be Vcom or any arbitrary voltage defined by the practical requirement of the LC. It is noted that the reset/preset action is different from the conventional driving method, and has the function of discharge of the mirror but help for the response rate of the LC. From the view of driving the LC, the response rate of the LC is significantly relative to voltage difference. Therefore, in each sub-frame time, the value of reset/preset voltage for the LC can be over-driving. Since the effect voltage of the LC is reset or preset to low potential before the end of each sub-frame time. That is, before the coming of next sub-frame time, the arrangement of LC has arranged to the condition defined by the reset/preset signal (sometime the LC can not come to the condition of zero potential due to longer decay time). Before the coming of next sub-frame time, the LC is almost charged on (namely, rise time). From the general theory and practical experience of the LC with TN mode, most gray rise time is faster than decay time. The light-strobing time decides the image quality of the LCD using the LCOS cell. Therefore, the second embodiment of the present invention not only save the data-write time but also reduce the LC response time, and then increases the light-strobling time to improve the image quality of the LCD using the LCOS cell. The technology of the over-drive for LCD can refer to U.S. Pat. No. 6,329,971, all incorporated herein by reference.

The novel circuit design according to the present invention applied to the LCOS can adequately use the wafer IC process. Since the devices can be manufactured in small size and the circuit can be fabricated under the reflective mirror, the colored single-piece projector of field sequential mode can be implemented by the LCOS. In addition, the reset/preset action not only provides development space for designers to design the LC part of the LCOS, but also solves the residual DC problem, which has existed for a long time in development of LCOS, since the reset/preset voltage can be designed as inverse potential to offset the boundary ion so as to eliminate the residual DC.

From the above description, the present invention practically fabricates the samples of LCOS for measuring the response time of LC, wherein the LCOS has the conditions of cell gap=2.4 um, twist nematic 80°, and LC material using for common three-piece projector. While measuring the response time of LC, the voltage range of the LC response is divided into eight gray-voltage for driving and then an optical detector detects the light variation. The measuring results are shown below as a table. The table can be a lookup table as reference of the reset/preset voltage. The technology of the lookup table for LCD can refer to U.S. Pat. No. 6,043,797, all incorporated herein by reference. In the novel driving method of the present invention, the response rate of the LC will increases effectively to meet the requirement of the FS model if the LC can be reset or preset to the suitable potential.

| | 0 | 1 | 2 | 3 | 4 | 5 | 6 | 7 |
|---|---|---|---|---|---|---|---|---|
| 0 | | 0.363 | 0.339 | 0.337 | 0.346 | 0.359 | 0.390 | 0.447 |
| 1 | 3.293 | | 2.782 | 2.755 | 2.896 | 3.032 | 3.203 | 3.660 |
| 2 | 3.913 | 3.848 | | 3.795 | 3.968 | 4.146 | 4.424 | 5.171 |
| 3 | 4.758 | 4.450 | 4.502 | | 5.017 | 4.979 | 5.535 | 6.806 |
| 4 | 5.269 | 5.120 | 5.186 | 5.315 | | 5.744 | 6.301 | 8.271 |
| 5 | 5.549 | 5.553 | 5.590 | 5.736 | 6.202 | | 7.378 | 10.260 |
| 6 | 5.593 | 5.817 | 5.845 | 6.595 | 6.709 | 7.915 | | 16.787 |
| 7 | 3.135 | 3.229 | 3.361 | 3.350 | 3.438 | 3.272 | 3.048 | |

Figure 1:
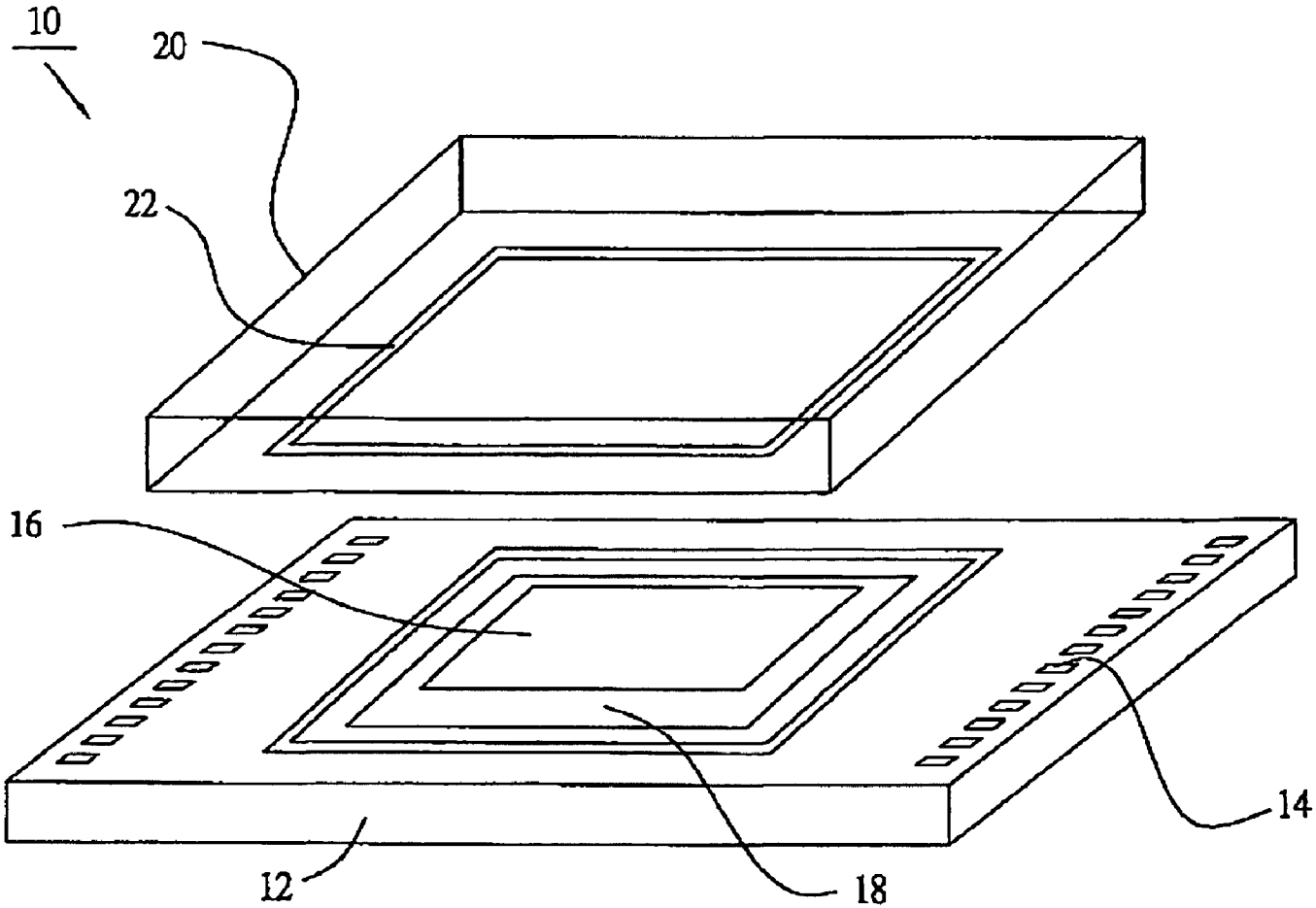
FIG. 1 (PRIOR ART)
FIG. 1 is an exploded, perspective view of a conventional LCOS display device.
Figure 2A:
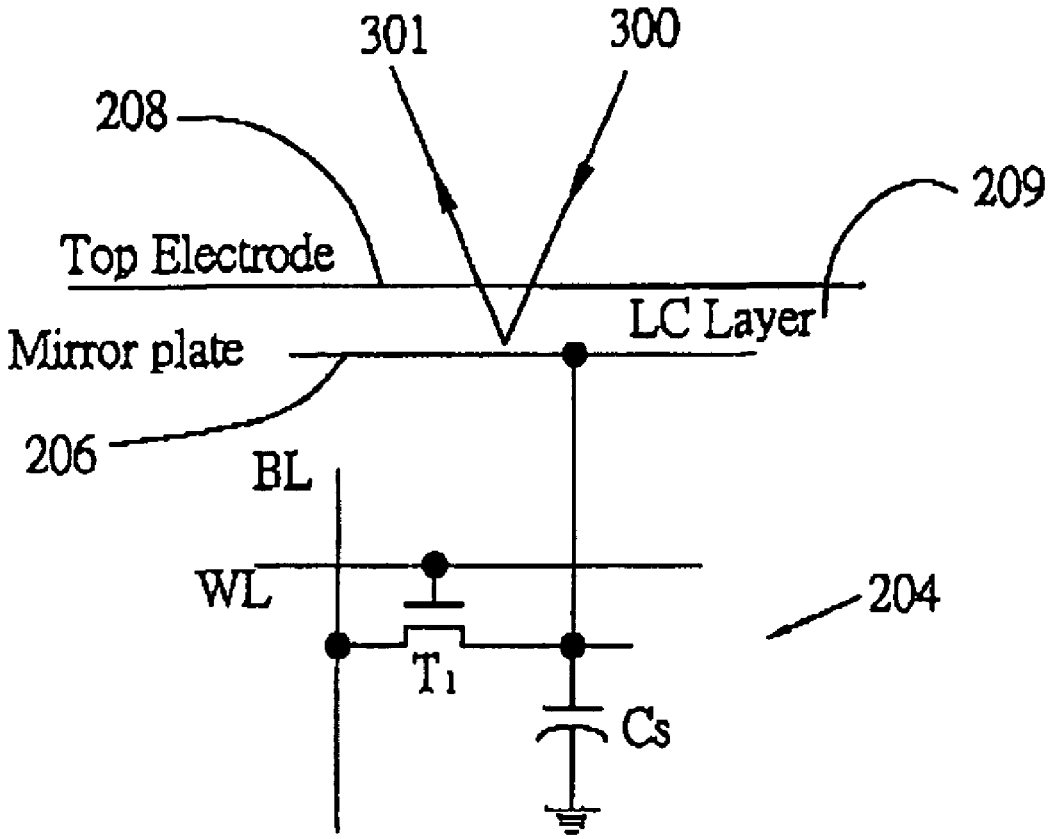
FIG. 2a (PRIOR ART)
FIG. 2*a* is a schematic circuit diagram of a conventional LCOS cell structure having one transistor and one capacitor.
Figure 2B:
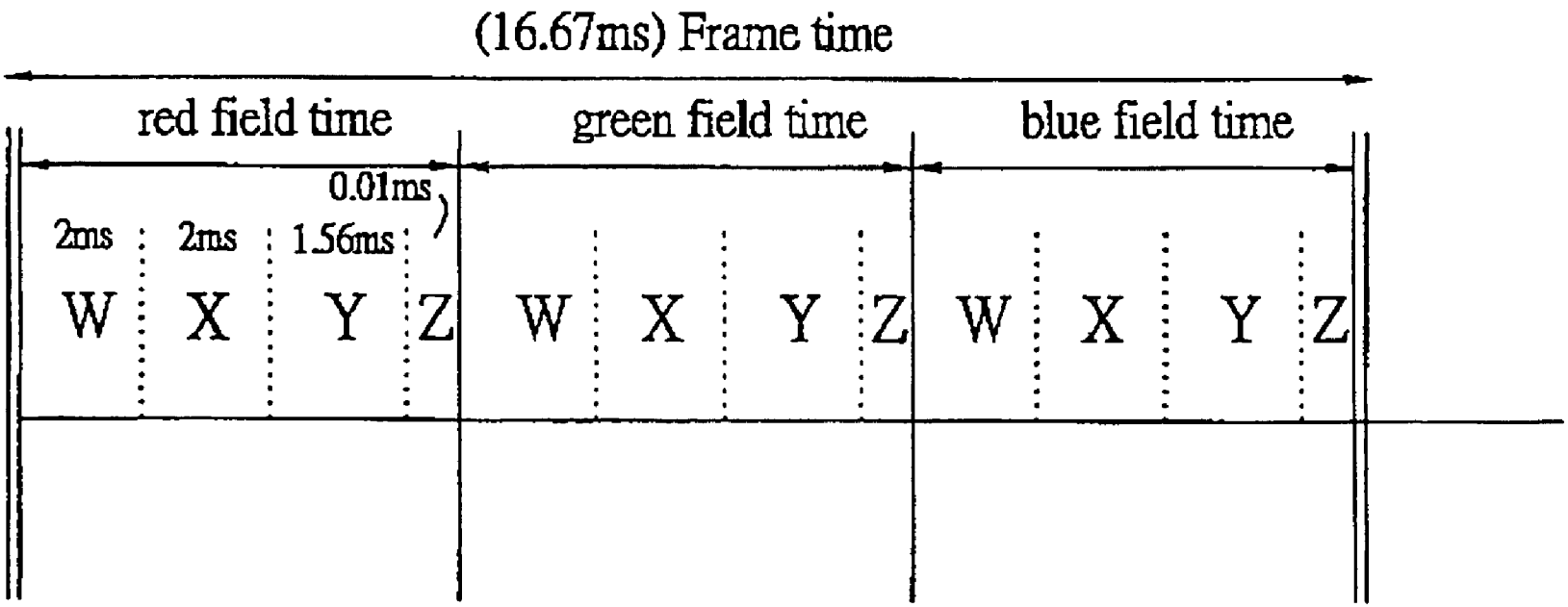
FIG. 2b (PRIOR ART)
FIG. 2*b* is a timing diagram showing the sequences of operation of the LCOS cell structure of FIG. 2*a*.
Figure 3A:
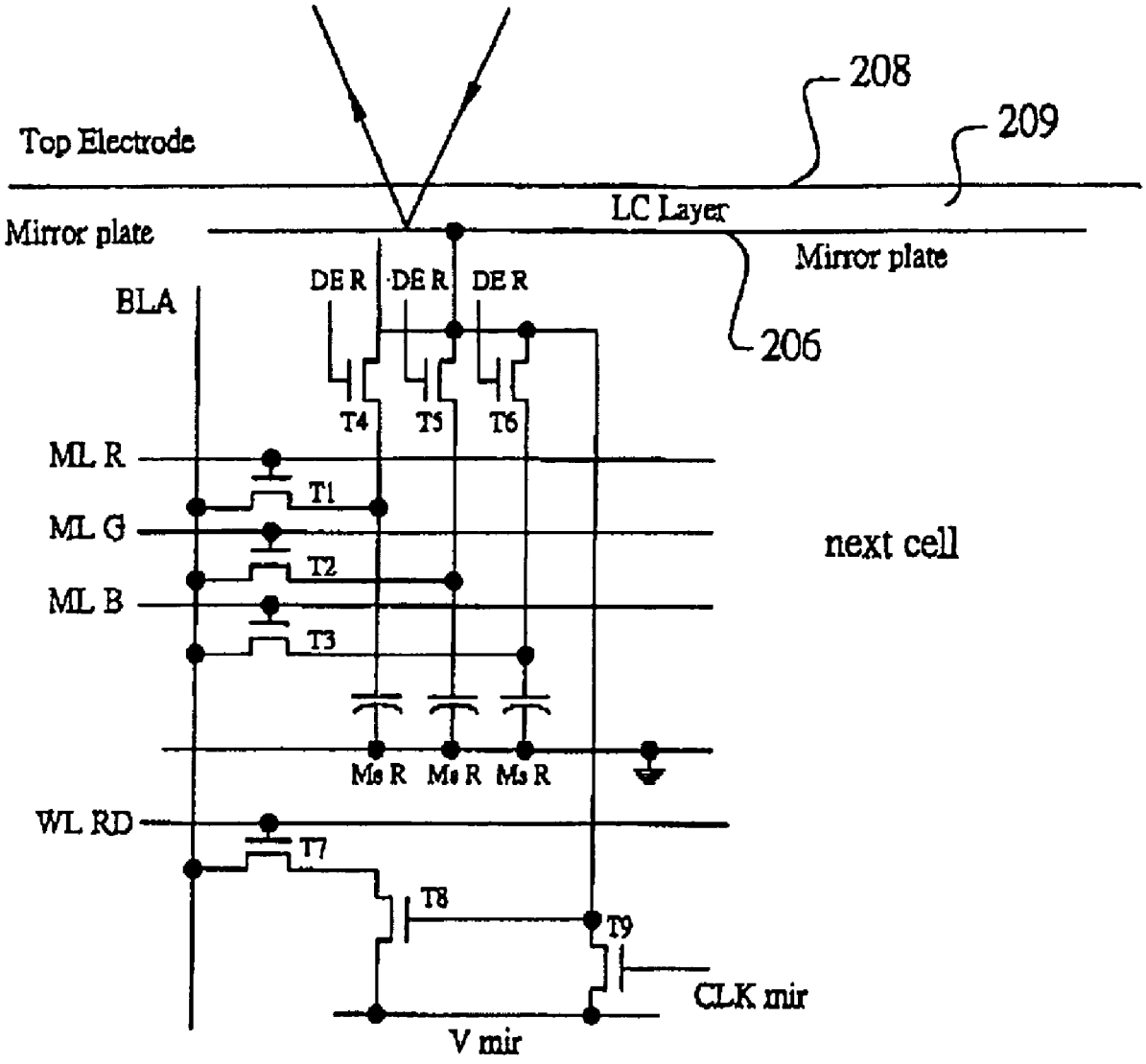
FIG. 3a (PRIOR ART)
FIG. 3*a* is a schematic circuit diagram of a conventional LCOS cell structure having six transistors and three capacitors.
Figure 3B:
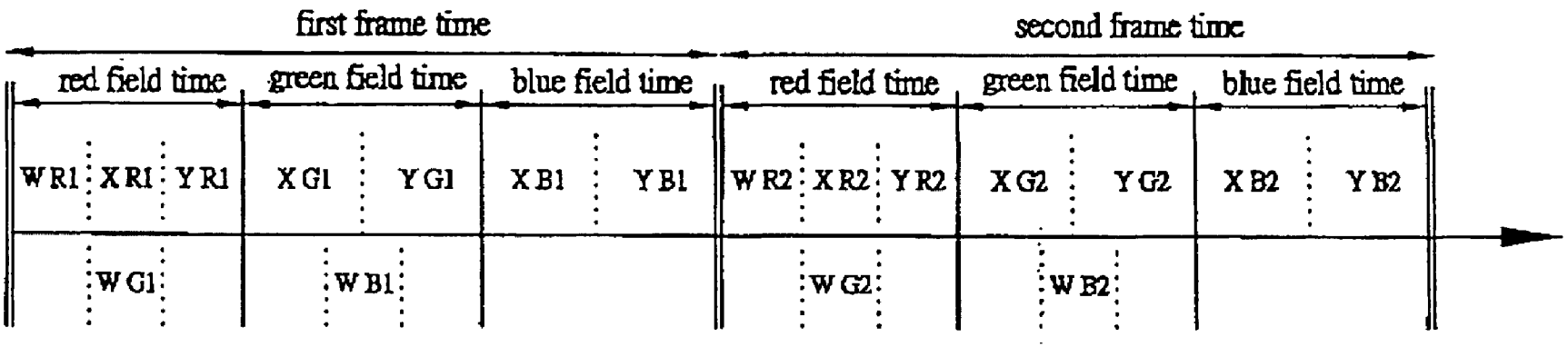
FIG. 3b (PRIOR ART)
FIG. 3*b* is a timing diagram showing the sequences of operation of the LCOS cell structure of FIG. 3*a*.
Figure 8:
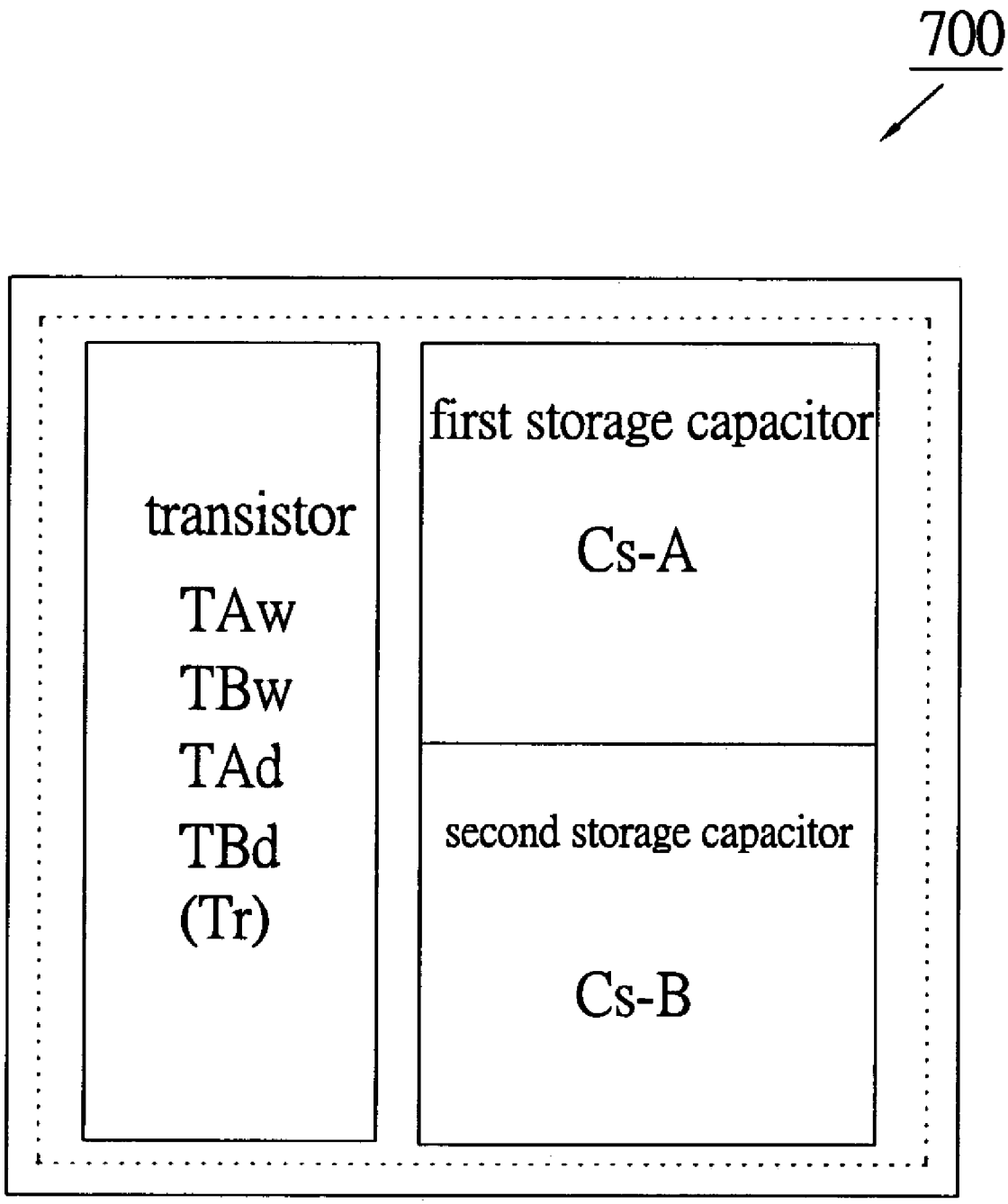
FIG. 8 is a top plan view of a single square pixel illustrating the location of the elements of FIG. 4 and FIG. 6.

FIG. 8 is a top plan view of a single square pixel illustrating the location of the elements of FIG. 4 and FIG. 6. The two RGB storage capacitors Cs_A11 and Cs_B11 are preferably positioned on the right side of the square pixel. The write-enable transistors TAw11 and TBw11,the display-enable transistors TAd11 and TBd11 and the reset/preset transistor Tr11 are all preferably positioned on the left side of the pixel. The area of each storage capacitor is less than the area of the single storage capacitor shown in FIG. 2. However, by utilizing a suitable CMOS technology, such as a non-volatile, double-poly-silicon CMOS technology, a highly reliable capacitor having a high capacitive value can be fabricated. In addition, the area of each storage capacitor is larger than the area of the single storage capacitor shown in FIG. 3. Therefore, by utilizing a suitable CMOS technology, a highly reliable capacitor having a high capacitive value of the present invention can be fabricated more easily. The LCOS cell must have a certain minimum size in order for the mirror plate (designated by the dotted line) to reflect the proper amount of light for displaying the color image. Thus, the minimum dimension on each side is on the order of microns which is sufficiently large enough to accommodate the two storage capacitors when using the current sub-micron CMOS technology. It is to be noted that the driving circuit and the control method of the liquid crystal display of the present invention are described in detail based on the LCOS device. It is to be understood that the driving circuit and the control method of the liquid crystal display of the invention are not only used in the reflection LCD such as the LCOS device but also in the display device operable in the FS mode such as the transmission LCD.

Although the invention has been explained in relation to its preferred embodiment, it is not used to limit the invention. It is to be understood that many other possible modifications and variations can be made by those skilled in the art without departing from the spirit and scope of the invention as hereinafter claimed.

What is claimed is:

1. A driving circuit of a liquid crystal cell structure for controlling a liquid crystal display (LCD) device operable in a field sequential mode to display plurality of colors, the LCD having a top electrode, a lower electrode, and a liquid crystal sandwiched between the top electrode and lower electrode, the driving circuit comprising:

first and second write-enable transistors, each of the first and the second write-enable transistors having a gate, a source and a drain;

first and second storage capacitors, each of the first and the second storage capacitors having a first end and a second end;

first and second display-enable transistors, each of the first and the second display-enable transistors having a gate, a source and a drain;

each of the first and the second write-enable transistors having its source connected to a shared bitline and having its gate connected to one of two corresponding word lines;

each of the first and the second write-enable transistors having its drain connected to the first end of one of the first and the second storage capacitors and to the source of one of the first and the second display-enable transistors, the second end of the first and the second storage capacitors being connected to a ground potential;

each of the first and second write-enable transistors corresponding to the plurality of colors in a one to many relationship; and each of the first and the second display-enable transistors having its drain connected to the lower electrode and having its gate connected to one of two corresponding display-enable lines.

2. The driving circuit of a liquid crystal cell structure as claimed in claim 1, wherein the liquid crystal cell structure is liquid crystal on silicon (LCOS) display cell and the lower electrode is a mirror electrode.

3. The driving circuit of a liquid crystal cell structure as claimed in claim 1, wherein the liquid crystal cell structure is a transmission liquid crystal display.

4. The driving circuit of a liquid crystal cell structure as claimed in claim 1, further comprising a controller which divides a frame time into a sequence of a first color field time, a second color field time and a third color field time; each of the first color field time, the second color field time and the third color field time having three pipe times consisting of a liquid crystal (LC) response time, a light-strobing time, and a reset/preset time, wherein the first display-enable transistor is turned on through the LC response time and the light-strobing time of the first color field time until presence of the reset/preset time; the second write-enable transistor is turned on to sequentially pre-load the video data of the second color into the second storage capacitor during the LC response time and the light-strobing time of the first color field time; during the reset/preset time of the first color field time, the second display-enable transistor and the second write-enable transistor are turned off while the first display-enable transistor and the first write-enable transistor are turned on to transmit a reset/preset voltage to set the voltage of the LC through the bitline; then the above steps repeat in order in the second color field time, the third color field time and the first color field time, each repetition alternating use of the first and second write-enable transistors, the first and second display-enable transistors, and the first and second storage capacitors.

5. The driving circuit of a liquid crystal cell structure as claimed in claim 4, wherein the reset/preset voltage transmitted through the bitline is a Vcom value of the top electrode.

6. The driving circuit of a liquid crystal cell structure as claimed in claim 4, wherein the reset/preset voltage transmitted through the bitline is based on the overdrive voltage of the arrangement of the liquid crystal before a next color field time.

7. A controlling method for an LCD device operating in a field sequential mode, the LCD device including first and second write-enable transistors, first and second storage capacitors associated with the first and second write-enable transistors, first and second display-enable transistors associated with the first and second storage capacitors and a bitline associated with the first and second write-enable transistors; and a frame time being divided into a sequence of a first color field time, a second color field time and a third color field time, each being divided into three pipe times consisting of an LC response time, a light-strobing time, and a reset/preset time; wherein the controlling method comprises the steps of:

(a) turning on the first display-enable transistor through the LC response time and the light-strobing time of the first color field time until the presence of the reset/preset time;

(b) turning on the second write-enable transistor to sequentially pre-load the video data of the second color into the second storage capacitor during the LC response time and the light-strobing time of the first color field time;

(c) turning on the first write-enable transistor and still turning on the first display-enable transistor but turning off the second display-enable transistor and the second write-enable transistor to transmit a reset/preset signal to set the LC voltage through the bitline during the reset/preset time of the first color field time; and (d) processing the above steps in order and repeating in the second color field time, the third color field time, and the first color field time wherein each repetition alternates use of the first and second write-enable transistors, the first and second display-enable transistors, and the first and second storage capacitors.

8. The controlling method as claimed in claim 7, wherein the reset/preset voltage transmitted through the bitline is set to be a Vcom value.

9. The controlling method as claimed in claim 7, wherein the reset/preset voltage transmitted through the bitline is based on the overdrive voltage of the arrangement of the liquid crystal before a next color field time.

10. The controlling method as claimed in claim 7, wherein the reset/preset time is less than the LC response time and the light-strobing time.

11. A driving circuit of a liquid crystal cell structure for controlling a liquid crystal display (LCD) device operable in a field sequential mode to display plurality of colors, the LCD device having a top electrode, a lower electrode, and a liquid crystal sandwiched between the top electrode and the lower electrode, the driving circuit comprising:

first and second write-enable transistors, each of the first and the second write-enable transistors having a gate, a source and a drain;

first and second storage capacitors, each of the first and the second storage capacitors having a first end and a second end;

first and second display-enable transistors, each of the first and the second display-enable transistors having a gate, a source and a drain;

a reset/preset transistor having a gate, a source and a drain;

each of the first and the second write-enable transistors having its source connected to a shared bitline and having its gate connected to one of two corresponding wordlines;

each of the first and the second write-enable transistors having its drain connected to the first end of one of the first and the second storage capacitors and to the source of one of the first and the second display-enable transistors, the second end of the first and the second storage capacitors being connected to a ground potential;

each of the first and second write-enable transistors corresponding to the plurality of colors in a one to many relationship;

each of the first and the second display-enable transistors having its drain connected to the lower electrode and having its gate connected to one of two corresponding display-enable lines; and the reset/preset transistor having its drain connected to the lower electrode, its gate connected to a reset/preset line and its source connected to a reset/preset voltage.

12. The driving circuit of a liquid crystal cell structure as claimed in claim 11, wherein the liquid crystal cell structure is liquid crystal on silicon (LCOS) display cell and the lower electrode is a mirror electrode.

13. The driving circuit of a liquid crystal cell structure as claimed in claim 11, wherein the liquid crystal cell structure is transmission liquid crystal display.

14. The driving circuit of a liquid crystal cell structure as claimed in claim 11, further comprising a controller which divides a frame time into a sequence of a first color field time, a second color field time and a third color field time; each of the first color field time, the second color field time and the third color field time having three pipe times consisting of a liquid crystal (LC) response time, a light-strobing time, and a reset/preset time, wherein the first display-enable transistor is turned on through the LC response time and the light-strobing time of the first color field time until the presence of the reset/preset time; the second write-enable transistor is turned on to sequentially pre-load the video data of the second color into the second storage capacitor during the LC response time and the light-strobing time of the first color field time; during the reset/preset time of the first color field time, as the first display-enable transistor, the first write-enable transistor, the second display-enable transistor and the second write-enable transistor are all turned off, the reset/preset transistor is turned on to transmit a reset/preset voltage to set the voltage of the LC.

15. The driving circuit of a liquid crystal cell structure as claimed in claim 14, wherein the reset/preset voltage transmitted through the bitline is a Vcom value of the top electrode.

16. The driving circuit of a liquid crystal cell structure as claimed in claim 14, wherein the reset/preset voltage is based on the overdrive voltage of the arrangement of the liquid crystal before next color field time.

17. A controlling method for an LCD device operating in a field sequential mode, the LCD device including first and second write-enable transistors, first and second storage capacitors associated with the first and second write-enable transistors, first and second display-enable transistors associated with the first and second storage capacitors, a bitline associated with the first and second write-enable transistors and a reset/preset transistor associated with the first and second display-enable transistors; and a frame time being divided into a sequence of a first color field time, a second color field time and a third color field time each being divided into three pipe times consisting of an LC response time, a light-strobing time, and a reset/preset time; wherein the controlling method comprises the steps of:

(a) turning on the first display-enable transistor through the LC response time and the light-strobing time of the first color field time until the presence of the reset/preset time;

(b) turning on the second write-enable transistor to sequentially pre-load the video data of the second color into the second storage capacitor during the LC response time and the light-strobing time of the first color field time;

(c) turning on the reset/preset transistor to set the voltage of LC to the reset/preset voltage during the reset/preset time of the first color field time when the first and second display-enable transistors, the first and second write-enable transistors are all turned off;

(d) processing the above steps in order and repeating in the second color field time, the third color field time and the first color field time wherein each repetition alternates use of the first and second write-enable transistors, the first and second display-enable transistors, and the first and second storage capacitors.

18. The controlling method as claimed in claim 17, wherein the reset/preset voltage is a Vcom value of the top electrode.

19. The controlling method as claimed in claim 17, wherein the reset/preset voltage is based on the overdrive voltage of the arrangement of the liquid crystal before a next color field time.

20. The controlling method as claimed in claim 17, wherein the reset/preset time is less than the LC response time and the light-strobing time.

21. A liquid crystal cell structure, comprising:

a top electrode;

a lower electrode;

a liquid crystal sandwiched between the top electrode and lower electrode;

first and second write-enable transistors, each of the first and the second write-enable transistors having a gate, a source and a drain;

first and second storage capacitors, each of the first and the second storage capacitors having a first end and a second end; and first and second display-enable transistors, each of the first and the second display-enable transistors having a gate, a source and a drain;

wherein each of the first and the second write-enable transistors has its source connected to a shared bitline and has its gate connected to one of two corresponding wordlines;

wherein each of the first and the second write-enable transistors has its drain connected to the first end of one of the first and the second storage capacitors and to the source of one of the first and the second display-enable transistors, the second end of the first and the second storage capacitors are connected to a ground potential;

wherein each of the first and the second display-enable transistors has its drain connected to the lower electrode and has its gate connected to one of two corresponding display-enable lines;

by the controlling-signal of operation of the bitlines and the display-enable lines, the video data of the bitlines is stored for a while into the first and the second storage capacitors alternatively and transformed alternatively to be output into the lower electrode;

by the controlling-signal of operation of the bitlines and the display-enable lines, the reset/preset signal of the bitlines can set the potential of the lower electrode.

22. A liquid crystal cell structure, comprising:

a top electrode;

a lower electrode;

a liquid crystal sandwiched between the top electrode and lower electrode; and a driving circuit consisting essentially of:

first and second write-enable transistors, each of the first and the second write-enable transistors having a gate, a source and a drain;

first and second storage capacitors, each of the first and the second storage capacitors having a first end and a second end;

first and second display-enable transistors, each of the first and the second display-enable transistors having a gate, a source and a drain; and a reset/preset transistor having a gate, a source and a drain;

wherein each of the first and the second write-enable transistors has its source connected to a shared bitline and has its gate connected to one of two corresponding wordlines;

wherein each of the first and the second write-enable transistors has its drain connected to the first end of one of the first and the second storage capacitors and to the source of one of the first and the second display-enable transistors, the second end of the first and the second storage capacitors are connected to a ground potential;

wherein each of the first and the second display-enable transistors has its drain connected to the lower electrode and has its gate connected to one of two corresponding display-enable lines; and wherein the reset/preset transistor has its drain connected to the lower electrode, its gate connected to a reset/preset line and its source connected to a reset/preset voltage;

by the controlling-signal operation of the bitlines, the display-enable lines and the reset/preset line, the video data of the bitlines is stored for a while into the first and the second storage capacitors alternatively and transformed alternatively to be output into the lower electrode;

by the controlling-signal operation of the bitlines, the display-enable lines and the reset/preset line, the potential of the lower electrode can be reset or preset to reset/preset voltage.

* * * * *